US005922248A

United States Patent [19]

Wooderson

[11] Patent Number: 5,922,248

[45] Date of Patent: Jul. 13, 1999

[54] ROOM HUMIDIFYING ASSEMBLY

[76] Inventor: Blaise M. Wooderson, 15820 W. 131st St., Olathe, Kans. 66062

[21] Appl. No.: 08/865,655

[22] Filed: May 29, 1997

[51] Int. Cl.[6] ..... B01F 3/04

[52] U.S. Cl. ..... 261/105; 261/107; 454/348; 454/362

[58] Field of Search ..... 55/234, 415, DIG. 35, 55/DIG. 37; 261/105, 107; 454/347, 348, 358, 361, 362

[56] References Cited

U.S. PATENT DOCUMENTS

| | | | |
|---|---|---|---|
| 420,542 | 2/1890 | O'Leary | 454/362 |
| 515,068 | 2/1894 | Ashburn | 454/362 |
| 1,121,542 | 12/1914 | Wegner | 55/234 |
| 1,782,374 | 11/1930 | Walls | 261/107 |
| 1,876,959 | 9/1932 | Kelsea et al. | 261/107 |
| 1,887,242 | 11/1932 | Martinson | 261/107 |
| 2,576,848 | 11/1951 | Mercier et al. | 454/358 |
| 5,240,487 | 8/1993 | Kung | 55/DIG. 35 |

FOREIGN PATENT DOCUMENTS

| | | | |
|---|---|---|---|
| 61-116231 | 6/1986 | Japan | 454/361 |

OTHER PUBLICATIONS

Owner's Manual for Evaporative Register Humidifier Model MoistAIR™ 500.

*Primary Examiner*—C. Scott Bushey

*Attorney, Agent, or Firm*—Hovey, Williams, Timmons, & Collins

[57] ABSTRACT

A room humidifying assembly (20) is provided which is easily and quickly installed, is simple to operate, and is a cost effective means for maintaining a comfortable humidity level in a room. The room humidifying assembly (20) preferably includes a body (22), adapted for positioning within a ventilation duct (24) adjacent a duct outlet (26), and a wick (32) having a first section (34) and a second section (36). The body (22) includes a reservoir (28) adapted to hold a supply of water, and the second section (36) of the wick (32) is disposed within the reservoir (28) in contact with the water therein. The first section (34) of the wick (32) is supported across at least a portion of the duct (24) by an apertured frame (30) secured to the body (22) to permit the passage of ventilating air through the first section (34). The wick (32) is configured for delivery of water from the second section (36) to the first section (34) by capillary attraction. The first section (34) of the wick (32) is foramenous to allow passage of air therethrough. Additionally, the assembly (20) includes an apertured grille structure (76) mounted adjacent the duct outlet (26) which provides a damper (84) for regulating the amount of air passing therethrough.

4 Claims, 2 Drawing Sheets

20
22
42
34
76
38
98
3
122
94
100
102
92
28
88
96
90
60
32
82
80
104
112a
110a
112c
110c
108
112b
110b
106
8
9
7

ROOM HUMIDIFYING ASSEMBLY

BACKGROUND OF THE INVENTION

1. Field of the Invention

The present invention relates to a room humidifying assembly adapted for use in a ventilation duct. More particularly, the invention pertains to such a humidifying assembly which includes a body having a water-holding reservoir adapted for placement within a duct adjacent a duct outlet, and a wick having a section thereof disposed within the reservoir in contact with the water and another section thereof supported across at least a portion of the duct. Water is delivered between sections of the wick by capillary attraction, and the wick is formed of foramenous material to permit the passage of ventilating air therethrough to thereby humidify the air.

2. Description of the Prior Art

Room humidifiers have become a necessity in regions where significantly low relative humidity is prevalent, such as regions having extended winter periods. Excessive skin dryness and frequent static electricity shocks are undesirable consequences of such low humidity levels. Accordingly, room humidifiers have been developed to eliminate such concerns by providing a means for raising humidity levels to achieve optimum comfort.

Room humidifiers of varying complexity are known in the art. A sophisticated and costly humidification system can be installed for use with an existing forced-air heating system. This type of system requires an electrical feed, a control system and a water line tap in order to operate, and will provide humidification for a number of rooms. Another form of humidifier is the portable electric device which includes a water-holding reservoir and an electric fan for circulating humidified air throughout a room. Another device for raising room humidity levels consists of a receptacle which contains a water-holding reservoir and a filter and is designed for placement over a floor heat register. The bottom of the filter maintains contact with the water and the remainder of the filter remains damp as a result of capillary attraction. Room humidity levels are raised as air discharges from the floor register and passes through the filter.

The devices of the prior art, however, have several notable drawbacks. The humidifier designed for use with an existing heating system can be very expensive and difficult to install. Significant ongoing maintenance is usually required. The portable room humidifier is typically noisy when in operation. Both the portable room humidifier and the floor register humidifying unit can be rather bulky in structure and thus present a somewhat unfavorable addition to the decor of a room. Further, such devices can present a safety hazard if placed in a high traffic area where occupants are likely to stumble over such devices. Finally, the floor register unit must be temporarily removed in order to adjust the damper to regulate the airflow through the register, which could be a strenuous endeavor if the water reservoir is completely full.

SUMMARY OF THE INVENTION

The problems outlined above are in large measure solved by the room humidifying assembly in accordance with the present invention. That is to say, the assembly hereof is specially designed to be easily and quickly installed within the ventilation duct, is simple to operate, and is a cost effective means for maintaining a comfortable humidity level in a room. Room decor remains basically unaffected and any potential safety hazards due to stumbling over a floor-mounted unit are eliminated because essentially all of the assembly is designed to be installed within the duct.

The room humidifying assembly of the present invention broadly includes a body, adapted for positioning within a ventilation duct adjacent a duct outlet, and a wick having a first section and a second section. The body provides a reservoir adapted to hold a supply of water, and the second section of the wick is disposed within the reservoir in contact with the water therein. The first section of the wick is supported across at least a portion of the duct by an apertured frame secured to the body to permit the passage of ventilating air through the first section. The wick is configured for delivery of water from the second section to the first section by capillary attraction. The first section of the wick is foramenous to allow passage of air therethrough.

In particularly preferred forms, the duct outlet is located at a floor of the room, and the body is configured for placement within the duct beneath the duct outlet. Additionally, an apertured grille structure is mounted adjacent the duct outlet and includes a damper for regulating the amount of air passing therethrough.

DETAILED DESCRIPTION OF THE PREFERRED EMBODIMENT

Figure 1:
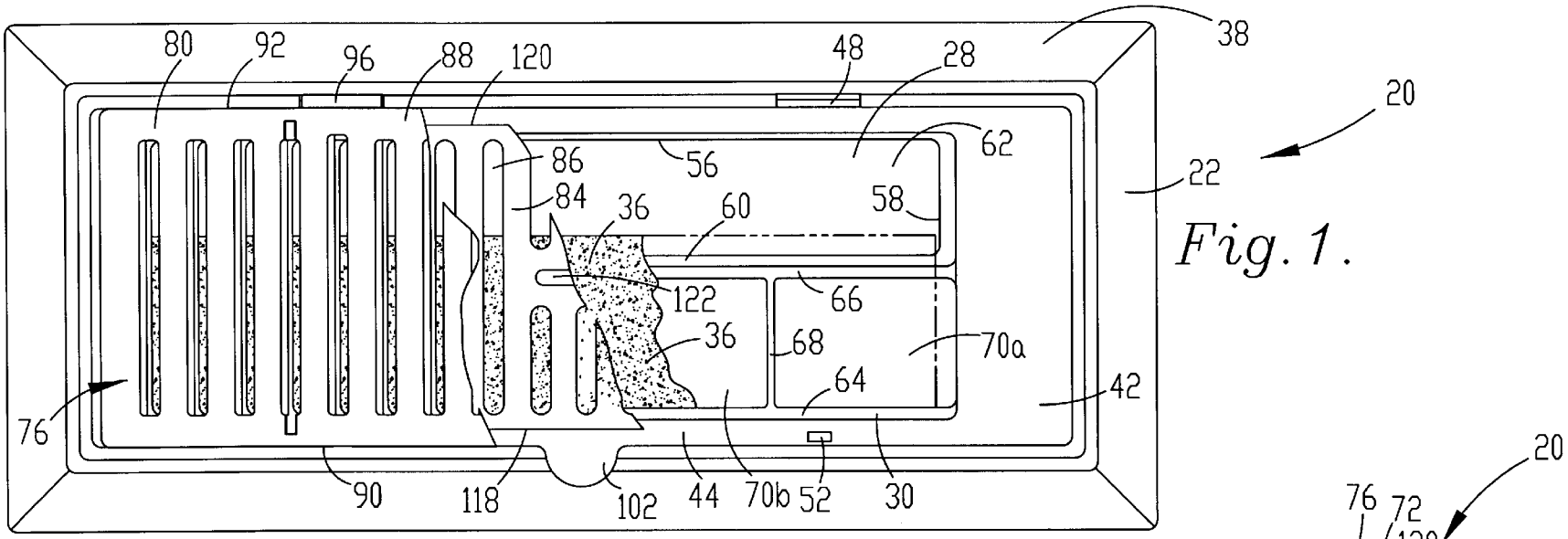
FIG. 1 is a top view of the preferred room humidifying assembly in accordance with present invention with portions of the cover plate, damper member and wick broken away to reveal the apertured frame and the reservoir.

Turning now to the drawings, FIG. 1 illustrates a preferred room humidifying assembly 20 in accordance with the invention. Broadly, assembly 20 includes an integral, synthetic resin body 22, adapted for positioning within a ventilation duct 24 adjacent a duct outlet 26, and a generally L-shaped, inverted wick 32 which presents a first section 34 and a second section 36. Body 22 includes a reservoir 28 adapted to hold a supply of water and an apertured frame 30.

In more detail, body 22 includes a continuous, circumscribing, generally rectangular, oblique flange 38 for engaging the surface 40 of a floor in the room adjacent outlet 26, and a generally rectangular apertured section 42 inwardly extending from flange 38. Section 42 presents forward and rearward opposed sides 44, 46, and provides a pair of spaced tab-receiving slots 48 (only one of which is shown in FIG. 1) adjacent rearward side 46 and a pair of latch slots 52 (only one of which is shown) adjacent forward side 44. Rectangular reservoir 28 is of integral design and includes four downwardly extending and converging walls 54, 56, 58, 60 and a generally planar bottom panel 62 which cooperatively hold a supply of water (approximately one quart). The reservoir fills approximately ½ of the outlet. Frame 30 is a part of section 42 and presents a top surface 64 and extends from wall 60 transversely across a portion of duct 24 to forward side 44 of section 42. Frame 30 includes a generally rectangular continuous, inwardly extending margin 66 and a plurality of spaced triangular gussets 68 (only one of which is shown) extending transversely from wall 60 to forward side 44 of section 42. A series of openings such as the depicted openings 70*a,* 70*b* are defined by margin 66 and gussets 68 for the passage of ventilating air therethrough. It will be appreciated that each gusset 68 provides an oblique lower edge 72 which is configured to engage the inner surface 74 of outlet 26 and thereby serves to limit any transverse shifting of body 22 within duct 24.

In preferred forms, assembly 20 includes an apertured grille structure 76 having a damper system for regulating the amount of air passing therethrough. Grille structure 76 includes a cover plate 80 presenting a plurality of oblique, transversely extending slots or apertures 82, and a damper member 84 slidably coupled beneath cover plate 80 and also presenting a plurality of transversely extending slots or apertures 86. Cover plate 80 and damper member 84 are both of integral construction and each are preferably formed of synthetic resin material.

Figures 2, 4, 7, 8, 9:
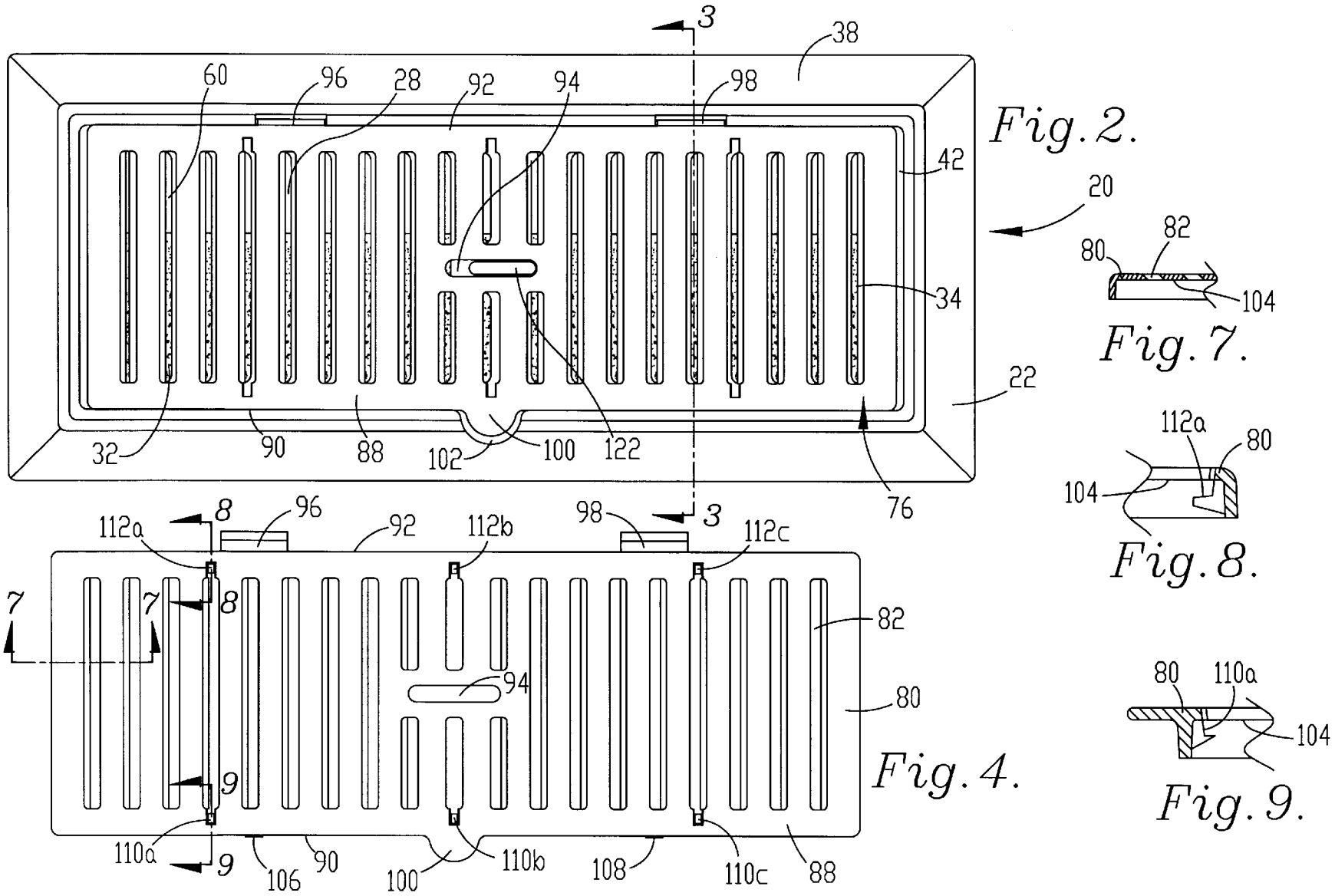
FIG. 2 is a plan view of the room humidifying assembly.
FIG. 4 is a plan view of the cover plate.
FIG. 7 is a fragmentary sectional view taken along the line 7—7 of FIG. 4, which illustrates the oblique apertures of the cover plate.
FIG. 8 is a fragmentary sectional view taken along the line 8—8 of FIG. 4, which illustrates a ledge secured to the inboard face of the cover plate for slidable coupling of the damper member.
FIG. 9 is a fragmentary sectional view taken along line 9—9 of FIG. 4, which illustrates another ledge secured to the inboard face of the cover plate for slidable coupling of the damper member.

As illustrated in FIG. 4, cover plate 80 presents an outboard face 88, a forward side 90 and an opposed rearward side 92. Cover plate 80 includes a centrally located, operator-receiving, longitudinal slot 94, a pair of outwardly extending tabs 96, 98 secured to the rearward side 92, and an outwardly extending finger projection 100 coupled to the forward side 90 for receipt and support by recess 102 of flange 38. Tabs 96, 98 are configured for pivotal insertion into respective slots 48, 50 of body 22 for allowing pivotal opening and closing movement of grille structure 76 between open and closed positions. Cover plate 80 further presents an inboard face 104 having a pair of latch hooks 106, 108 coupled to the forward side 90 and extending downwardly from inboard face 104 for securement within respective latch slots 52. A set of three ledges 110*a,* 110*b,* 110*c* are coupled to the forward side 90 and extend downwardly from the inboard face 104 (see FIG. 9), and a corresponding set of three ledges 112*a,* 112*b,* 112*c* are coupled to the rearward side 92 and extend downwardly from the inboard face 104 (see FIG. 8).

Figure 5:
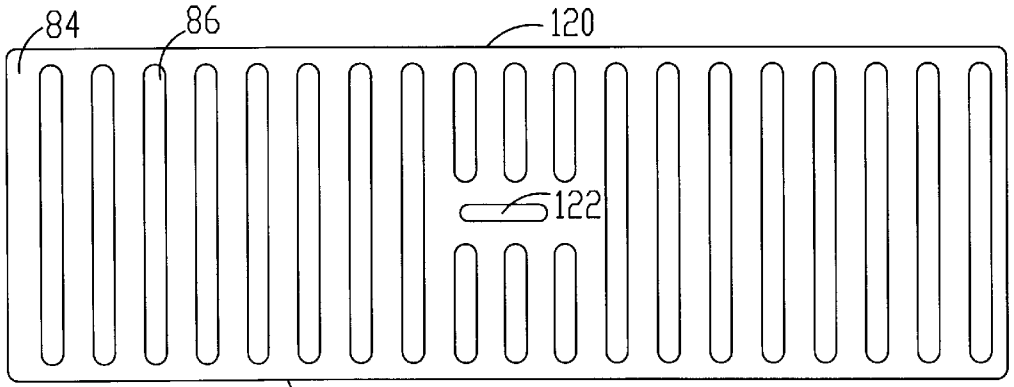
FIG. 5 is a plan view of the damper member.
Figure 6:
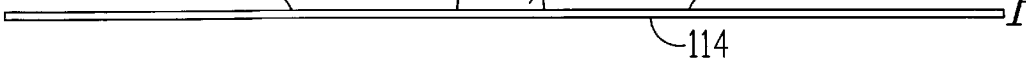
FIG. 6 is a side elevational view of the damper member.

As illustrated in FIGS. 5 and 6, damper member 84 presents inboard and outboard faces 114, 116, opposing forward and rearward edges 118, 120, and is provided with a centrally located operator 122 extending outwardly from outboard face 116 and configured for shiftable receipt within slot 94. Damper member 84 is slidably coupled beneath cover plate 80 by insertion of rearward edge 120 of damper member 84 into corresponding ledges 112*a,* 112*b,* 112*c* of cover plate 80, placement of operator 122 into slot 94, and snap-fitting of forward edge 118 of damper member 84 into corresponding ledges 110*a,* 110*b,* 110*c* of cover plate 80. It will be appreciated that damper member 84 is sufficiently resilient to allow such snap-fitting installation.

Figure 3:
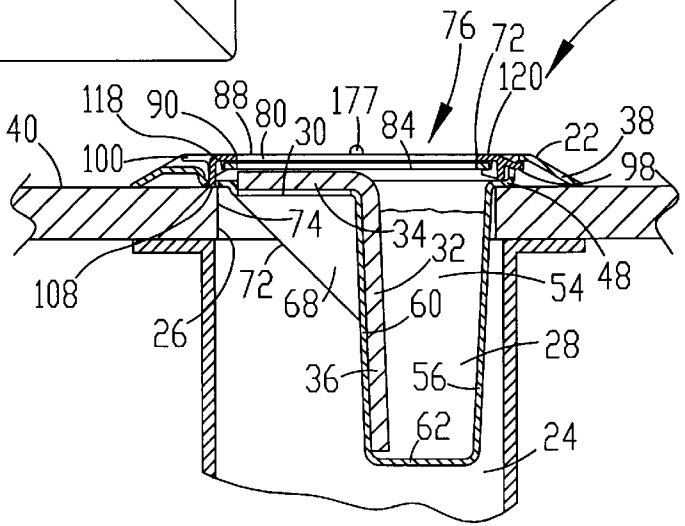
FIG. 3 is a fragmentary sectional view taken along the line of 3—3 of FIG. 2, which illustrates the location of the wick within the reservoir and the support of the wick by the apertured frame.

FIGS. 2 and 3 illustrate assembly 20 installed in an outlet 26 located within a floor of a room. Such installation consists of the removal of the existing floor register (not shown) and then the placement of body 22 within a substantially rectangular internal passageway 27 defined by the four (4) duct walls 29 of the duct 24 until flange 38 engages the floor surface 40. Next, reservoir 28 is filled with water and then second section 36 of wick 32 is disposed within reservoir 28 in contact with the water. First section 34 of wick 32 is then placed on and supported by top surface 64 of frame 30. Finally, grille structure 76 is pivotally secured to body 22 by insertion of tabs 96, 98 into respective slots 48, 50, and is locked into place by lowering finger projection 100 into recess 102 and insertion of latch hooks 106, 108 into respective latch slots 52.

In operation, water is delivered from second section 36 to first section 34 of wick 32 by capillary attraction. Wick 32 adheres to wall 60 of reservoir 28 and recessed top surface 64 of frame 30 when damp and rests on the gussets 68. Wick 32 is also foramenous to permit the passage of air through the first section 34 thereof. For each such purpose, wick 32 is preferably formed of laminated layers of expanded cellulose material.

Openings 70*a,* 70*b,* first section 34 of wick 32, and apertures 86, 82 of damper member 84 and cover plate 80 are collectively positioned to permit the passage of air therethrough. As air passes through first section 34 of wick 32, it is humidified via contact with the water held in first section 34 which covers the openings 70*a,* 70*b.* As humidified air flows out of grille structure 76, it is diffused somewhat by the oblique configuration of cover plate apertures 82 (see FIG. 7). Once the water level has dropped due to evaporation, a user simply pivotally lifts grille structure 76 using finger projection 100 and refills reservoir 28 with water.

It may be desirable, however, to regulate the flow of air discharging from assembly 20 in order to achieve optimum comfort. Accordingly, a user may shift operator 122 between open and closed positions thereof to correspondingly increase or decrease such airflow. Upon shifting of operator 122 to the open position thereof (see FIG. 2), damper member 84 is correspondingly shifted so that apertures 86, 82 of damper member 84 and cover plate 80 are in full alignment and airflow is basically unobstructed. Upon shifting of operator 122 toward the closed position thereof (such position is not shown), damper member 84 is correspondingly shifted so that apertures 86, 82 of damper member 84 and cover plate 80 are in misalignment, which results in the obstruction of air and thereby reduces the amount of airflow therethrough.

Those skilled in the art will appreciate that the teachings of the room humidifying assembly 20 hereof may include a variety of embodiments in addition to the preferred embodiment hereinabove described. For example, body 22 may be configured for placement within a duct 24 adjacent an outlet 26 in a wall or a ceiling in a room. In such event, the size, shape and arrangement of components may require appropriate modification.

I claim:

1. A room humidifying assembly in combination with a ventilation duct, of a room; the ventilation duct including: four duct walls, a substantially rectangular internal passageway defined by the four duct walls, and a duct outlet of the room; the humidifying assembly comprising:

a substantially rectangular body positioned within the substantially rectangular internal passageway adjacent to the duct outlet, the body including: a continuous, circumscribing, generally rectangular flange engaging a surface around the duct outlet, a generally rectangular section extending inwardly from the flange, an aperture defined by the rectangular section, a pair of spaced apart tab receiving slots defined by the rectangular section, a pair of latch slots defined by the rectangular section opposite the tab receiving slots, and a plurality of spaced apart and substantially triangular gussets extending across the aperture;

a generally rectangular refillable reservoir integrally formed in the body and having four downwardly extending and converging walls integrally joined by a generally planar bottom to cooperatively hold an approximately one quart supply of water, the reservoir filling approximately one-half of the duct outlet, and the gussets extending from one of the four converging walls to the rectangular section;

a wick including a first foramenous section permitting passage of air therethrough, the first foramenous section covering the aperture and resting on the gussets, and the wick further including a second section disposed within the reservoir in contact with the water supply and, when wet, adhered to the one of the four converging walls of the reservoir, and water being delivered from the second section to the first section by capillary attraction; and an apertured grille structure including a pair of tabs pivotably received in the pair of tab receiving slots allowing the grille structure to pivot between open and closed positions, a pair of latch hooks removably secured in the pair of latch slots to prevent the grille structure from pivoting between the open and closed positions when the latch hooks are in the latch slots, a cover plate presenting a plurality of apertures, and a damper member slidably coupled to said cover plate and presenting a plurality of apertures for regulating the amount of air passing through the cover plate.

2. The humidifying assembly of claim 1, wherein the body comprises a recessed top surface and the first section of the wick, when wet, adheres to the recessed top surface.

3. The humidifying assembly of claim 1, wherein the wick is generally L-shaped.

4. The humidifying assembly of claim 1, wherein the wick comprises laminated layers of expanded cellulose material.

* * * * *